US007976196B2

(12) United States Patent
Ivey et al.

(10) Patent No.: US 7,976,196 B2
(45) Date of Patent: Jul. 12, 2011

(54) METHOD OF FORMING LED-BASED LIGHT AND RESULTING LED-BASED LIGHT

(75) Inventors: John Ivey, Farmington Hills, MI (US); David L Simon, Grosse Pointe Woods, MI (US)

(73) Assignee: Altair Engineering, Inc., Troy, MI (US)

( * ) Notice: Subject to any disclaimer, the term of this patent is extended or adjusted under 35 U.S.C. 154(b) by 230 days.

(21) Appl. No.: 12/169,918

(22) Filed: Jul. 9, 2008

(65) Prior Publication Data

US 2010/0008085 A1 Jan. 14, 2010

(51) Int. Cl.
*F21V 29/00* (2006.01)

(52) U.S. Cl. .... 362/294; 362/218; 362/373; 362/249.06

(58) Field of Classification Search ..... 362/218, 362/294, 373, 249.02, 249.06, 249.14
See application file for complete search history.

(56) References Cited

U.S. PATENT DOCUMENTS

| | | | |
|---|---|---|---|
| 54,511 | A | 2/1920 | Owen |
| 58,105 | A | 6/1921 | Poritz |
| 79,814 | A | 8/1929 | Hoch |
| 80,419 | A | 1/1930 | Kramer |
| 84,763 | A | 7/1931 | Stange |
| D119,797 | S | 4/1940 | Winkler et al. |
| D125,312 | S | 2/1941 | Logan |
| 2,909,097 | A | 10/1959 | Alden et al. |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, Iii |
| 3,958,885 | A | 5/1976 | Stockinger et al. |
| 3,974,637 | A | 8/1976 | Bergey et al. |

(Continued)

FOREIGN PATENT DOCUMENTS

CN 1584388 A 2/2005

(Continued)

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

(Continued)

*Primary Examiner* — Thomas M Sember
(74) *Attorney, Agent, or Firm* — Young Basile

(57) ABSTRACT

A method of forming a LED-based light for replacing a conventional fluorescent bulb in a fluorescent light fixture includes shaping an elongate sheet of highly thermally conductive material to fashion a heat sink. Shaping the heat sink allows fashioning the heat sink to define cover and end cap attachment structures, surfaces for mounting LEDs at various angles, and a high surface area to width ratio for dissipating heat.

22 Claims, 4 Drawing Sheets

U.S. PATENT DOCUMENTS

| | | | |
|---|---|---|---|
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,271,408 | A | 6/1981 | Teshima et al. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,771,274 | A | 9/1988 | Havel |
| 4,780,621 | A | 10/1988 | Bartleucci et al. |
| 4,794,383 | A | 12/1988 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,912,371 | A | 3/1990 | Hamilton |
| 4,922,154 | A | 5/1990 | Cacoub |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,979,081 | A | 12/1990 | Leach et al. |
| 4,980,806 | A | 12/1990 | Taylor et al. |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |
| 5,412,552 | A | 5/1995 | Fernandes |
| 5,420,482 | A | 5/1995 | Phares |
| 5,421,059 | A | 6/1995 | Leffers, Jr. |
| 5,430,356 | A | 7/1995 | Ference et al. |
| 5,432,408 | A | 7/1995 | Matsuda et al. |
| 5,436,535 | A | 7/1995 | Yang |
| 5,436,853 | A | 7/1995 | Shimohara |
| 5,450,301 | A | 9/1995 | Waltz et al. |
| 5,461,188 | A | 10/1995 | Drago et al. |
| 5,463,280 | A | 10/1995 | Johnson |
| 5,465,144 | A | 11/1995 | Parker et al. |

5,475,300 A 12/1995 Havel
5,489,827 A 2/1996 Xia
5,491,402 A 2/1996 Small
5,493,183 A 2/1996 Kimball
5,504,395 A 4/1996 Johnson et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,790,329 A 8/1998 Klaus et al.
5,803,579 A 9/1998 Turnbull et al.
5,803,580 A 9/1998 Tseng
5,803,729 A 9/1998 Tsimerman
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,946,209 A 8/1999 Eckel et al.
5,949,347 A 9/1999 Wu
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,068,383 A 5/2000 Robertson et al.
6,069,597 A 5/2000 Hansen
6,072,280 A 6/2000 Allen
6,084,359 A 7/2000 Hetzel et al.
6,091,200 A 7/2000 Lenz
6,092,915 A 7/2000 Rensch
6,095,661 A 8/2000 Lebens et al.
6,097,352 A 8/2000 Zavracky et al.
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,241,359 B1 6/2001 Lin
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,394,623 B1 5/2002 Tsui
D458,395 S 6/2002 Piepgras et al.
6,400,096 B1 6/2002 Wells et al.

6,404,131 B1 6/2002 Kawano et al.
6,411,022 B1 6/2002 Machida
6,422,716 B2 7/2002 Henrici et al.
6,428,189 B1 8/2002 Hochstein
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,586,890 B2 7/2003 Min et al.
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,801,003 B2 10/2004 Schanberger et al.
6,806,659 B1 10/2004 Mueller et al.
6,814,470 B2 11/2004 Rizkin et al.
6,815,724 B2 11/2004 Dry
6,846,094 B2 1/2005 Luk
6,851,816 B2 2/2005 Wu et al.
6,851,832 B2 2/2005 Tieszen
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.

7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich et al.
7,211,959 B1 5/2007 Chou
7,213,934 B2 5/2007 Zarian et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang
7,427,840 B2 9/2008 Morgan et al.
7,429,117 B2 9/2008 Pohlert et al.
7,434,964 B1 * 10/2008 Zheng et al. ..... 362/294
7,438,441 B2 10/2008 Sun et al.
D580,089 S 11/2008 Ly et al.
D581,556 S 11/2008 To et al.
7,449,847 B2 11/2008 Schanberger et al.
D582,577 S 12/2008 Yuen
D584,428 S 1/2009 Li et al.
7,476,004 B2 1/2009 Chan
7,478,924 B2 1/2009 Robertson
D586,484 S 2/2009 Liu et al.
7,490,957 B2 2/2009 Leong et al.
7,497,596 B2 3/2009 Ge
7,507,001 B2 3/2009 Kit
7,510,299 B2 3/2009 Timmermans et al.
7,521,872 B2 4/2009 Bruning
7,524,089 B2 4/2009 Park
7,534,002 B2 5/2009 Yamaguchi et al.
7,549,769 B2 6/2009 Kim et al.
7,556,396 B2 7/2009 Kuo et al.
7,572,030 B2 8/2009 Booth et al.
7,575,339 B2 8/2009 Hung
7,619,366 B2 11/2009 Diederiks
7,635,201 B2 12/2009 Deng
D612,528 S 3/2010 McGrath et al.
7,690,813 B2 * 4/2010 Kanamori et al. ..... 362/249.02
2001/0033488 A1 10/2001 Chliwnyj et al.
2001/0045803 A1 11/2001 Cencur
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.

2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0248299 A1 11/2005 Chemel et al.
2005/0253533 A1 11/2005 Lys et al.
2005/0259424 A1 11/2005 Zampini, II et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1* 5/2006 Coushaine et al. ..... 362/373
2006/0126325 A1 6/2006 Lefebvre et al.
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0221606 A1 10/2006 Dowling et al.
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III 2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0153514 A1 7/2007 Dowling et al.
2007/0159828 A1 7/2007 Wang
2007/0165402 A1 7/2007 Weaver, Jr. et al.
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0205712 A1 9/2007 Radkov et al.
2007/0206375 A1 9/2007 Piepgras et al.
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247842 A1 10/2007 Zampini et al.
2007/0247847 A1 10/2007 Villard
2007/0247851 A1 10/2007 Villard
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0037245 A1 2/2008 Chan
2008/0037284 A1 2/2008 Rudisill
2008/0062680 A1 3/2008 Timmermans et al.
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094837 A1 4/2008 Dobbins et al.
2008/0130267 A1 6/2008 Dowling et al.
2008/0151535 A1* 6/2008 de Castris ..... 362/220
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0211419 A1 9/2008 Garrity
2008/0224629 A1 9/2008 Melanson
2008/0224636 A1 9/2008 Melanson
2008/0253125 A1 10/2008 Kang et al.
2008/0258647 A1 10/2008 Scianna
2008/0285257 A1 11/2008 King
2008/0290814 A1 11/2008 Leong et al.
2008/0291675 A1 11/2008 Lin et al.
2008/0315784 A1 12/2008 Tseng
2009/0002995 A1 1/2009 Lee et al.
2009/0016063 A1 1/2009 Hu
2009/0046473 A1 2/2009 Tsai et al.
2009/0052186 A1 2/2009 Xue
2009/0067182 A1 3/2009 Hsu et al.
2009/0086492 A1 4/2009 Meyer
2009/0091938 A1 4/2009 Jacobson et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0273926 A1 11/2009 Deng
2009/0303720 A1 12/2009 Mcgrath
2009/0316408 A1* 12/2009 Villard ..... 362/249.13

FOREIGN PATENT DOCUMENTS

CN 2766345 Y 3/2006
CN 2869556 Y 2/2007
EP 0013782 B1 3/1983
EP 0091172 A2 10/1983
EP 0124924 B1 9/1987
EP 0174699 B1 11/1988
EP 0197602 B1 11/1990
EP 0214701 B1 3/1992
EP 0262713 B1 6/1992
EP 0203668 B1 2/1993
EP 0272749 B1 8/1993
EP 0337567 B1 11/1993
EP 0390262 B1 12/1993
EP 0359329 B1 3/1994
EP 0403011 B1 4/1994
EP 0432848 B1 4/1995
EP 0403001 B1 8/1995
EP 0525876 B1 5/1996
EP 0714556 B1 1/1999
EP 0458408 B1 9/1999
EP 0578302 B1 9/1999
EP 0723701 B1 1/2000
EP 0787419 B1 5/2001
EP 1195740 A2 4/2002
EP 1016062 B1 8/2002
EP 1195740 A3 1/2003
EP 1149510 B1 2/2003
EP 1056993 B1 3/2003
EP 0766436 B1 5/2003
EP 0924281 B1 5/2003
EP 0826167 B1 6/2003
EP 1147686 B1 1/2004
EP 1142452 B1 3/2004
EP 1145602 B1 3/2004
EP 1422975 A1 5/2004
EP 0890059 B1 6/2004
EP 1348319 B1 6/2005
EP 1037862 B1 7/2005
EP 1346609 B1 8/2005
EP 1321012 B1 12/2005
EP 1610593 A2 12/2005
EP 1415517 B1 5/2006
EP 1415518 B1 5/2006
EP 1438877 B1 5/2006
EP 1166604 B1 6/2006
EP 1479270 B1 7/2006
EP 1348318 B1 8/2006
EP 1399694 B1 8/2006
EP 1461980 B1 10/2006
EP 1110120 B1 4/2007
EP 1440604 B1 4/2007
EP 1047903 B1 6/2007
EP 1500307 B1 6/2007
EP 0922305 B1 8/2007
EP 0922306 B1 8/2007
EP 1194918 B1 8/2007
EP 1048085 B1 11/2007
EP 1763650 B1 12/2007
EP 1776722 B1 1/2008
EP 1459599 B1 2/2008
EP 1887836 A2 2/2008
EP 1579733 B1 4/2008
EP 1145282 B1 7/2008
EP 1337784 B1 6/2009
EP 2013530 B1 8/2009
JP 6-54103 U 7/1994

| | | | |
|---|---|---|---|
| JP | 7-249467 | | 9/1995 |
| JP | 11-135274 | A | 5/1999 |
| JP | 2001-238272 | A | 8/2001 |
| JP | 2002-141555 | A | 5/2002 |
| JP | 3098271 | U | 2/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 3139714 | U | 2/2008 |
| KR | 10-2004-0008244 | A | 1/2004 |
| KR | 20-0430022 | Y1 | 11/2006 |
| KR | 10-0781652 | B1 | 12/2007 |
| WO | 99/10867 | A1 | 3/1999 |
| WO | 99/31560 | A2 | 6/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 7/2003 |
| WO | 03/067934 | A2 | 8/2003 |
| WO | 03/090890 | A1 | 11/2003 |
| WO | 03/096761 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | 2004/100624 | A2 | 11/2004 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | 2006/023149 | A2 | 3/2006 |
| WO | 20061093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2007/081674 | A1 | 7/2007 |
| WO | 2007/094810 | A2 | 8/2007 |

OTHER PUBLICATIONS

Experiment Electronic Ballast. Electronic Ballast For Fluorescent Lamps [online], Revised Fall of 2007. [Retrieved on Sep. 1, 1997]. Retrieved from Virginia Tech Web Page using Internet <URL: http://www.ece.vt.edu/ece3354/1abs/ballast.pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

Ledtronics, Ledtronics Catalog, 1996, p. 10, Ledtronics, Torrance, California.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Phason Electronic Control Systems, Light Level Controller (LLC) case study. Nov. 30, 2004. 3 pages, Phason Inc., Winnipeg, Manitoba, Canada.

Airport International. Fly High With Intelligent Airport Building and Security Solutions [online], [retrieved on Oct. 24, 2008]. Retrieved from Airport International web page using Internet <URL: http://www.airport-int.com/ categories/airport-building-and-security-solutions/fly-high-with-intelligent-airport-building-and-security-solutions.html>.

D.N.A.-III, [online], [retrieved Mar. 10, 2009] Retrieved from the PLC Lighting Web Page using Internet <URL: http:// www.plclighting.com/product_info.php?cPath=1&products_id=92>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.

E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.

E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.

Sensor Switch, nLight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http://www.encelium.com/products/strategies.html>.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.

Best Practice Guide—Commercial Office Buildings—Central HVAC System. [online], [Retrieved on Jan. 17, 2008] Retrieved from Flex Your Power Organization web page using Internet <URL:http://www.fypower.org/bpg/module.html?b=offices&m+Central HVAC Systems&s=Contr . . . >.

Cornell University. Light Canopy—Cornell University Solar Decathlon, [online], [retrieved on Jan. 17, 2008] Retrieved from Cornell University web page using Internet <URL:http://cusd.cornell.edu/cusd/web/index.php/page/show/section/Design/page/controls>.

Written Opinion and International Search Report of the International Search Authority dated Jan. 25, 2010 from the corresponding International Application No. PCT/US2009/048623 filed Jun. 25, 2009.

* cited by examiner

METHOD OF FORMING LED-BASED LIGHT AND RESULTING LED-BASED LIGHT

TECHNICAL FIELD

The present invention relates to a light emitting diode (LED) based light for replacing a conventional fluorescent light in a fluorescent light fixture.

BACKGROUND

Fluorescent tube lights are widely used in a variety of locations, such as schools and office buildings. Fluorescent tube lights include a gas-filled glass tube. Although conventional fluorescent bulbs have certain advantages over, for example, incandescent lights, they also pose certain disadvantages including, inter alia, disposal problems due to the presence of toxic materials within the glass tube.

LED-based tube lights which can be used as one-for-one replacements for fluorescent tube lights have appeared in recent years. However, LEDs produce heat during operation that is detrimental to their performance. Some LED-based tube lights include heat sinks to dissipate the heat generated by the LEDs, and some of these heat sinks include projections for increasing the surface area of the heat sink. The heat sinks are formed by extruding billets of material, generally aluminum, through a die.

BRIEF SUMMARY

The present invention provides an LED-based replacement light including a heat sink having a high surface area to width ratio shaped from a flat sheet of thermally conductive material for replacing a conventional fluorescent light in a fluorescent fixture. Compared to an extruded heat sink of a conventional LED-based replacement light, shaping a heat sink from a sheet of highly thermally conductive material can result in a heat sink with a greater surface area to width ratio, and thus a greater ability to dissipate heat. Moreover, a shaped heat sink according to the present invention requires less material to produce and has a lower weight than an extruded heat sink. Further, a shaped heat sink according to the present invention can be produced less expensively than an extruded heat sink. In general, a method of forming an LED-based light according to the present invention includes providing the heat sink by shaping an elongate sheet of highly thermally conductive material to increase the surface area to width ratio thereof. The method also includes mounting a plurality of LEDs in thermally conductive relation with the heat sink along its length, and enclosing the LEDs within a light transmitting cover.

In one illustrative embodiment, an LED-based light formed by the above method for replacing a conventional fluorescent bulb includes a light transmitting cover at least partially defining a tubular housing. A highly-thermally conductive heat sink is engaged with the cover. The heat sink has a high surface area to width ratio. Multiple LEDs are enclosed within the tubular housing and mounted in thermally conductive relation along a length of the heat sink for emitting light through the cover. At least one electrical connector at a longitudinal end of the tubular housing is in electrical communication with the multiple LEDs.

In another illustrative embodiment, an LED-based light for replacing a conventional fluorescent light bulb a fluorescent light fixture includes a hollow, cylindrical light transmitting tube. A heat sink shaped from a sheet of highly thermally conductive material has a width greater than a maximal width of the tube. The heat sink has a central planar portion and two side portions extending perpendicularly to the planar portion from opposing ends of the planar portion. The heat sink is positioned within the tube with the side portions in contact with an interior of the tube. A printed circuit board is mounted on the central planar surface, and multiple longitudinally spaced LEDs are mounted along the length of the circuit board. Two end caps are coupled to opposing ends of the tube, and the end caps carry bi-pin connectors in electrical communication with the circuit board.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
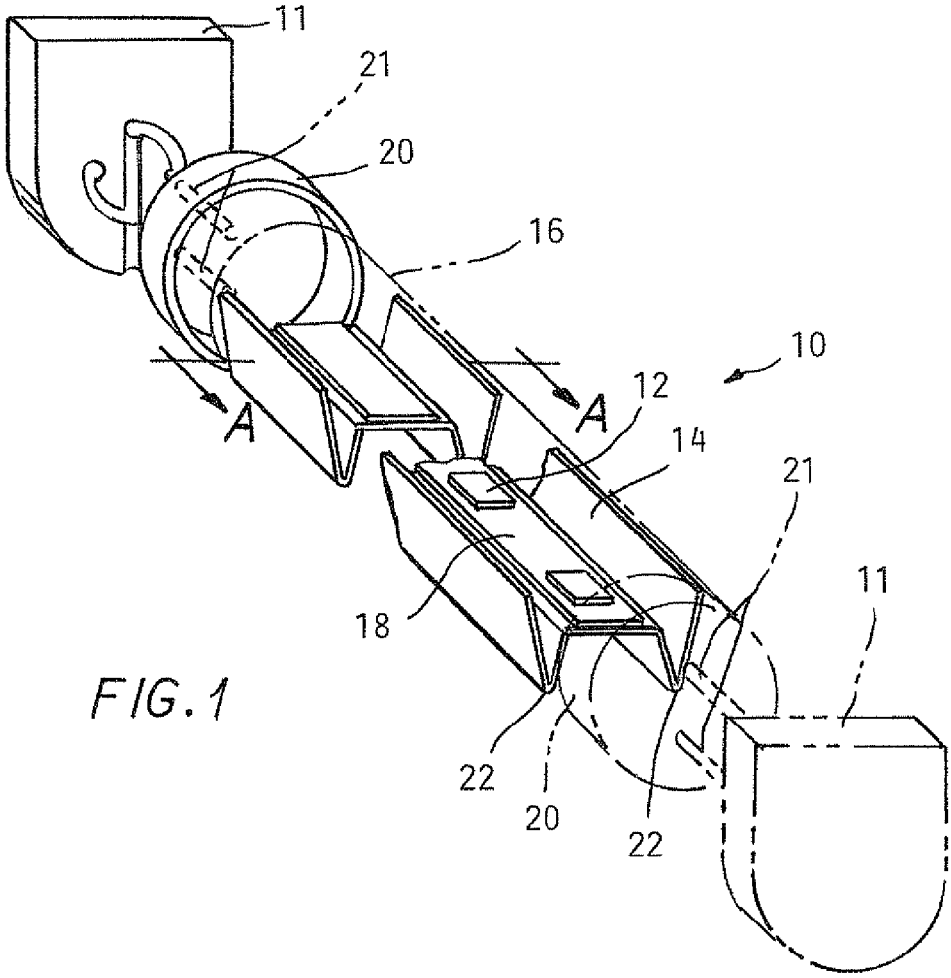
FIG. 1 is a perspective view of a LED-based replacement light with a heat sink having two longitudinal open fins.

Embodiments of an LED-based replacement light 10 according to the present invention are illustrated in FIGS. 1-11. In an embodiment of the light 10 illustrated in FIG. 1, the LED-based replacement light 10 includes LEDs 12, an elongate heat sink 14 shaped from a sheet of highly thermally conductive material, an elongate translucent tube 16, a circuit board 18, and end caps 20 carrying bi-pin connectors 21. The LED-based replacement light 10 can be dimensioned for use in a conventional fluorescent fixture 11. For example, the LED-based replacement light 10 can be 48" long with an approximately 1" diameter.

The LEDs 12 are preferably high-power, white light emitting LEDs 12, such as surface-mount devices of a type available from Nichia. The term "high-power" means LEDs 12 with power ratings of 0.25 watts or more. Preferably, the LEDs 12 have power ratings of one watt or more. However, LEDs with other power ratings, e.g., 0.05 W, 0.10 W, or 0.25 W, can alternatively be used. Although the LEDs 12 are shown as surface-mounted components, the LEDs 12 can be discrete components. Also, one or more organic LEDs can be used in place of or in addition to the surface-mounted LEDs 12. If desired, LEDs that emit blue light, ultra-violet light or other wavelengths of light, such as wavelengths with a frequency of 400-790 THz corresponding to the spectrum of visible light, can alternatively or additionally be included.

The LEDs 12 are mounted along the length of the circuit board 18 to uniformly emit light through a portion of the tube 16. The spacing between the LEDs 12 along the circuit board 18 can be a function of the length of the tube 16, the amount of light desired, the wattage of the LEDs 12, the number of LEDs 12, and the viewing angle of the LEDs 12. For a 48" light 10, the number of LEDs 12 may vary from about five to four hundred such mat the light 10 outputs approximately 500 to 3,000 lumens, and the spacing between the LEDs 12 varies accordingly. The arrangement of LEDs 12 on the circuit board 18 can be such as to substantially fill the entire spaced between the end caps 20. However, LEDs 12 need not be spaced to emit light uniformly.

The circuit board 18 may be made in one piece or in longitudinal sections joined by electrical bridge connectors. The circuit board 18 is preferably one on which metalized conductor patterns can be formed in a process called "printing" to provide electrical connections from the pins 21 to the LEDs 12 and between the LEDs 12 themselves. An insulative board is typical, but other circuit board types, e.g., metal circuit boards, can alternatively be used. Alternatively, a circuit can be printed directly onto the heat sink 14 depending on the heat sink 14 material.

Figure 2:
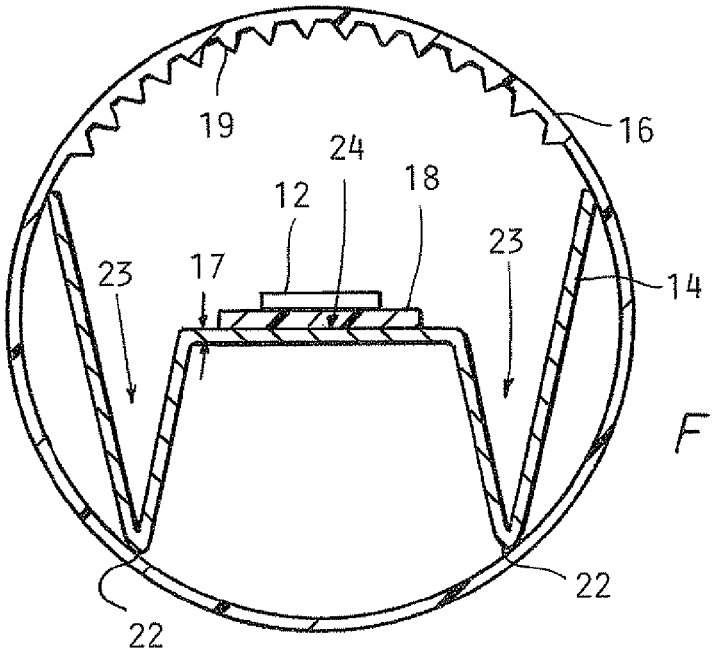
FIG. 2 is a cross-section view of FIG. 1 along line A-A.

FIG. 2 illustrates a cross-sectional view of the LED-based replacement light 10 of FIG. 1 along line A-A. A sheet of highly thermally conductive material has been shaped into a multi-planar, generally W-shape to fashion the heat sink 14. The process used to shape the sheet of material can be stamping, punching, deep drawing, bending, roll forming, forging, incremental sheet forming, thermoforming, or another sheet material shaping process. The specific process used can depend on the desired shape of the heat sink 14, the material properties of the sheet of flat material, and the production batch size. For example, punching may not be suitable to form a heat sink having a very high depth-to-width ratio, in which case deep drawing can be selected. As another example, certain plastics may not be sufficiently ductile for bending while at a normal room temperature and atmospheric pressure, but are formable using thermoforming. As a third example, roll forming may not be economical when a limited size production run is desired, in which case incremental sheet forming may be preferable. Additionally, multiple shaping processes can be carried out on the sheet of thermally conductive material to form a heat sink, examples of which are discussed later in regards to FIGS. 6 to 9. Also, the heat sink 14 need not be formed into a multi-planar shape. For example, the heat sink can have a curved profile if desired.

The heat conducting material can be aluminum, copper, an alloy, a highly thermally conductive plastic, a combination of materials (e.g., copper plated steel or a plastic impregnated with a metal powder filler), or another material known by one of skill in the art that can be shaped from a sheet to fashion the heat sink 14. The specific material used can depend on the heat generated by the LEDs 12, the thermal characteristics of the light 10, and the process used to shape the material. The material should be plastically deformable under shaping process conditions without fracturing. For example, if the heat sink 14 is to be formed by bending at room temperature and atmospheric pressure, a ductile material such as aluminum is preferably used.

The heat sink 14 can be shaped to include two longitudinally extending, open fins 22. Open fins 22 are portions of the sheet of material shaped into a "V", resulting in a space or cavity (hereinafter referred to as a depression 23) between the sides of each open fin 22. As a result, the sheet of material can have a width prior to shaping that is greater than the maximum width of the tube 16. Open fins 22 increase the surface area to width ratio of the heat sink 14, thereby increasing the ability of the heat sink 14 to dissipate heat. A high surface area to width ratio is a surface area to width ratio greater than twice the length of the heat sink 14 to one, by way of example and not limitation two and a half times the length of the heat sink 14 to one. Further, open fins 22 strengthen the heat sink 14. While the illustrated fins 22 extend longitudinally, with each fin 22 formed from two relatively obliquely angled integral lengths and of the heat sink 14 that converge at a generally pointed tip, alternative or additional fin shapes are possible. For example, the fins can extend radially instead of longitudinally, or the fins can have squared or U-shaped tips.

The heat sink 14 can also be shaped to include a longitudinally extending planar surface 24. The circuit board 18 can be mounted on the longitudinally extending planar surface 24 using thermally conductive adhesive transfer tape, glue, screws, a friction fit, and other attachments known to those of skill in the art. Thermal grease can be applied between the circuit board 18 and heat sink 14 if desired.

The tube 16 can be a hollow cylinder of polycarbonate, acrylic, glass, or another transparent or translucent material formed into a tubular shape by, for example, extrusion. The tube 16 can have a circular, oval, rectangular, polygonal, or other cross-sectional shape. The tube 16 can be clear or translucent. If the tube 16 is made of a high-dielectric material, the heat sink 14 is protected from unintentional contact that may transmit a charge resulting from capacitive coupling of the heat sink 14 and circuit board 18 resulting from a high frequency start-up voltage applied by the fixture 11 during installation of the light 10. However, the heat sink 14 receives less air flow when circumscribed by the tube 16. The manner in which the heat sink 14 and tube 16 are engaged depends on the structure of the particular heat sink 14 and tube 16. For example, as illustrated in FIG. 1, the heat sink 14 can be slidably inserted into the tube 16 and held in place by a friction fit. Alternatively, the heat sink 14 and tube 16 can be attached with glue, double-sided tape, fasteners, or other means known by those of skill in the art.

The light 10 can include features for uniformly distributing light to the environment to be illuminated in order to replicate the uniform light distribution of a conventional fluorescent bulb the light 10 is intended to replace. As described above, the spacing of the LEDs 12 can be designed for uniform light distribution. Additionally, the tube 16 can include light diffracting structures, such as the illustrated longitudinally extending ridges 19 formed on the interior of the tube 16. Alternatively, light diffracting structures can include dots, bumps, dimples, and other uneven surfaces formed on the interior or exterior of the tube 16. The light diffracting structures can be formed integrally with the tube 16, for example, by molding or extrusion, or the structures can be formed in a separate manufacturing step such as surface roughening. The light diffracting structures can be placed around an entire circumference of the tube 16, or the structures can be placed along an arc of the tube 16 through which a majority of light passes. In addition or alternative to the light diffracting structures, a light diffracting film can be applied to the exterior of the tube 16 or placed in the tube 16, or the material from which the tube 16 is formed can include light diffusing particles.

Alternatively to the tube 16 illustrated in FIGS. 1 and 2, the tube can be made from a flat or semi-cylindrical light transmitting cover extending a length and arc of the tube through which the LEDs 12 emit light and a semi-cylindrical dark body portion attached to the light transmitting portion. Due to its high infrared emissivity, the dark body portion dissipates a greater amount of heat to the ambient environment than a lighter colored body.

The end caps 20 as illustrated in FIGS. 1 and 2 carry bi-pin connectors 21 for physically and electrically connecting the LED-based replacement light 10 to the conventional fluorescent light fixture 11. Since the LEDs 12 are directionally oriented, the light 10 should be installed at a proper orientation relative to a space to be illuminated to achieve a desired illumination effect. Bi-pins connectors 21 allow only two light 10 installation orientations, thereby aiding proper orientation of the light 10. Also, only two of the four illustrated pins 21 must be active; two of the pins 21 can be "dummy pins" for physical but not electrical connection to the fixture 11. Alternative end caps can have different connectors, e.g., single pin connectors. Moreover, end caps 20 need not have a cup-shaped body that fits over a respective end of the tube 16. Alternative end caps can be press fit into the tube 16 or otherwise attached to the LED-based replacement light 10. Each end cap 20 can include a transformer, if necessary, and any other required electrical components to supply power to the LEDs 12. Alternatively, the electrical components can reside elsewhere in the LED-based replacement light 10.

Figure 3:
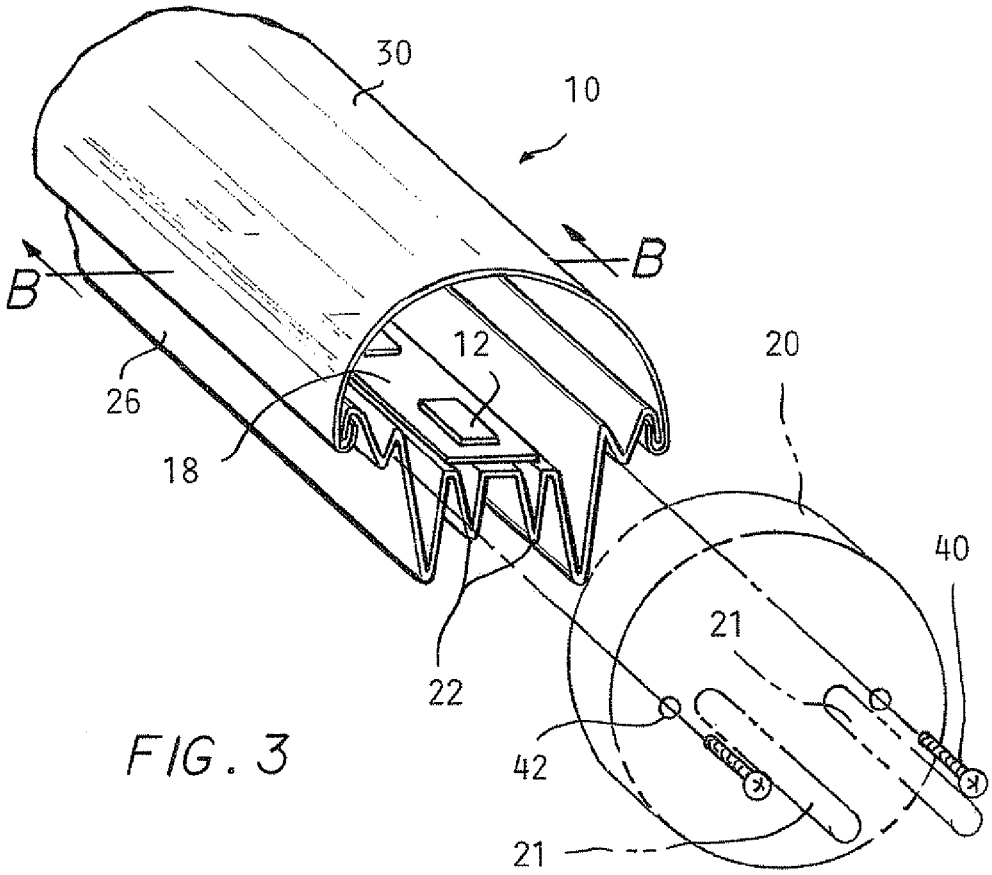
FIG. 3 is an exploded perspective view of a LED-based replacement light.
Figure 4:
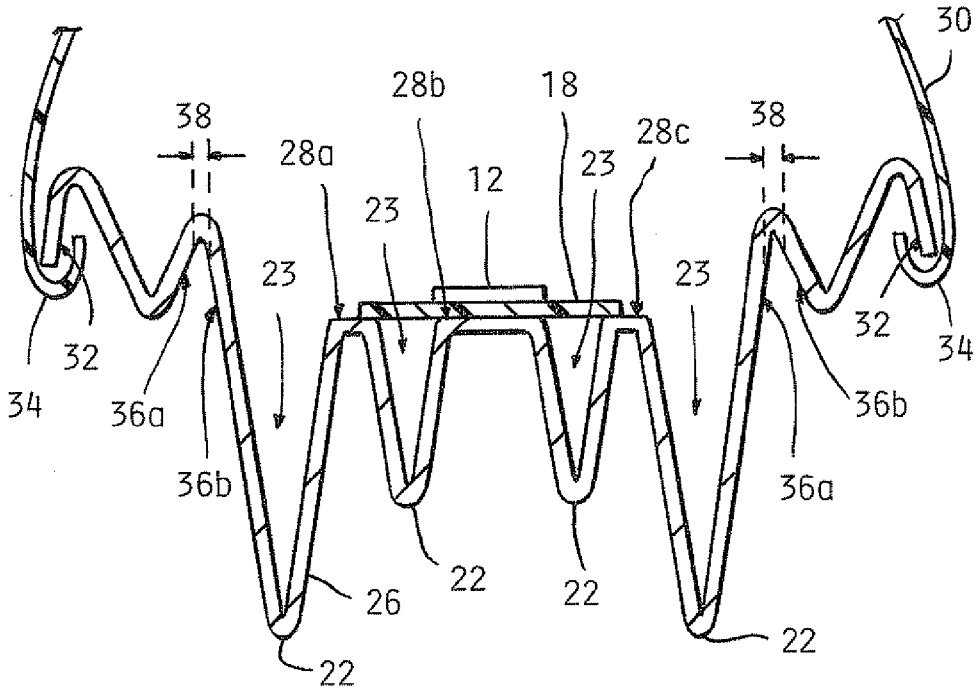
FIG. 4 is a cross-section view of FIG. 3 along line B-B.

FIGS. 3 and 4 illustrate another embodiment of the light 10 including a heat sink 26 shaped from a sheet of thermally conductive material and engaged with a light transmitting cover 30. The heat sink 26 is shaped to define three parallel planar surfaces 28*a*, 28*b* and 28*c* with two open fins 22 located between the respective adjacent surfaces. The circuit board 18 spans the fins 22 when mounted to the surfaces 28*a*, 28*b* and 28*c*. This configuration allows additional air flow to the circuit board 18 and increases the surface area of the heat sink 26. Alternatively, two or greater than three parallel planar surfaces separated by open fins 22 can be included.

The heat sink 26 can be shaped to include at least two longitudinally extending cover retaining surfaces 32. The cover 30 can include hooked longitudinal edges 34 that abut respective cover retaining surfaces 32 for engaging the cover 30 with the heat sink 26. The cover retaining surfaces 32 are preferably portions of the inside surfaces of lengths of the heat sink 26 that also define the longitudinal edges of the heat sink 26. When cover retaining surfaces 32 are portions of the inside surfaces of lengths of the heat sink 26 that also define longitudinal edges of the heat sink 26, a maximum area of the heat sink 26 remains exposed to the ambient environment surrounding the light 10 after engagement with the cover 30. Alternatively, the cover retaining surfaces 32 can be any surfaces abutted by the cover 30 for securing the cover 30 to the heat sink 26. For example, instead of the substantially U-shaped cover 30 illustrated in FIG. 3, the cover 30 can be nearly cylindrical with the hooked longitudinal edges 34 abutting adjacent cover retaining surfaces located near the middle of the width of a heat sink. Also, the cover retaining surfaces can have alternative shapes to the illustrated flat surfaces. For example, the cover retaining surface can form a groove if the cover includes a "tongue", such as a bulged longitudinal edge.

The heat sink 26 can also be shaped to include two sets of fastening surfaces 36*a* and 36*b* spaced apart in a direction perpendicular to the longitudinal axis of the heat sink 26. The two fastening surfaces 36*a* and 36*b* are spaced apart at a fastening location by a distance 38 substantially equal to a width of a fastener 40. The fastener 40 is inserted through an aperture 42 in the end cap 20, then friction fit, glued, screwed or otherwise attached between the two surfaces 36*a* and 36*b* for securing the end cap 20 to the heat sink 26. The exact distance 38 the fastening surfaces 36*a* and 36*b* are spaced apart depends on the type of fastener 40. For example, if the fastener 32 is a self-threading screw, the distance between the surfaces 36*a* and 36*b* can be slightly less than the width of the screw because the self-threading screw creates a concavity in each of the two fastening surfaces 36*a* and 36*b*, thereby preventing movement of the screw relative to the fastening surfaces 36*a* and 36*b*. The surfaces 36*a* and 36*b* can extend longitudinally the length of the heat sink 26 to permit the connection of an end cap 20 at each end of the LED-based replacement light 10, or the surfaces 36*a* and 36*b* can extend only a portion of the length from one or both ends of the heat sink 26. As shown, the end cap 20 has two apertures 42 for respective fasteners 40, but one or more than two connection points are also possible. Shaping the heat sink 26 to include fastening surfaces 36*a* and 36*b* eliminates the need for a separate manufacturing step to configure the heat sink 26 for attachment with end caps 20.

The cover 30 can be a semi-cylindrical piece of polycarbonate, acrylic, glass, or another translucent material shaped by, for example, extrusion. The cover 30 can have an arced, flat, bent, or other cross-sectional shape. As mentioned above, the cover 30 can include hooked longitudinal edges 34 or other edges configured for engagement with the heat sink 26. The cover 30 can be clear or translucent. The cover 30 can include light diffracting structures similar to the longitudinally extending ridges 19 illustrated in FIG. 2. Alternatively, light diffracting structures can include dots, bumps, dimples, and other uneven surfaces formed on the interior or exterior of the cover 30. The light diffracting structures can be placed around an entire circumference of the cover 30, or the structures can be placed along an arc of the cover 30 through which a majority of light passes. In addition or alternative to the light diffracting structures, a light diffracting film can be applied to the exterior of the cover 30 or placed between the cover 30 and the heat sink 26, or the material from which the cover 30 is formed can include light diffusing particles.

The heat sink 26 and cover 30 are engaged by abutting the hooked longitudinal edges 34 with the cover retaining surface 32. This can be accomplished by sliding the heat sink 26 relative to the cover 30 or, if the cover 30 is made from a flexible material, abutting one hooked edge 34 of the cover with a retaining surface 32 of the heat sink 26, then flexing cover 30 to abut the other hooked edge 34 with the other retaining surface 32. Alternatively, the heat sink 26 and cover 30 can be screwed, glued, taped, or attached with other attachments known to those of skill in the art.

Since the heat sink 26 includes a large area exposed to the ambient environment, the heat transfer properties of the heat sink 26 are good. However, if the heat sink 26 is formed of an electrically conductive material, capacitive coupling between the heat sink 26 and circuit board 18 presents a shock hazard potential as described above. This problem can be reduced or eliminated by shaping the heat sink 26 from a sheet of high-dielectric heat conducting material, such as a D-Series material by Cool Polymers of Warwick, R.I.

Figure 5:
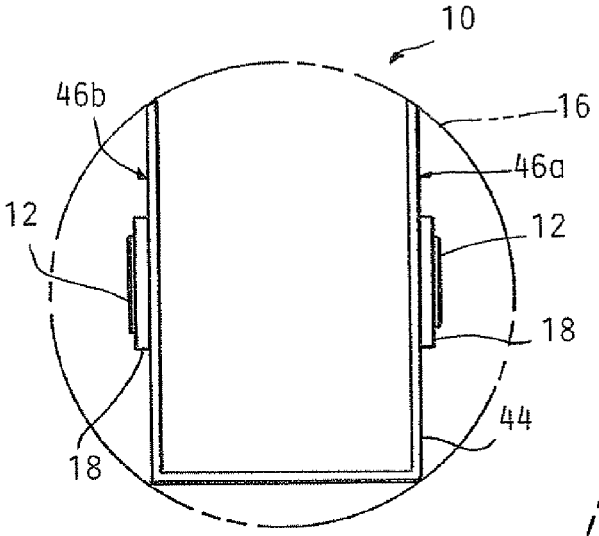
FIG. 5 is an end view of a heat sink having opposing facing LEDs positioned in a tube.

FIG. 5 illustrates another example of a heat sink 44 according to the present invention inserted in the tube 16. The heat sink 44 can be shaped to include multiple planar surfaces 46*a* and 46*b* angled relative to one another. As illustrated, the planar surfaces 46*a* and 46*b* are angled at 180° relative to one another. This formation permits two circuit boards 18 carrying LEDs 12 to be mounted facing opposite directions, thereby providing light around a greater amount of the circumference of the tube 16 than the LED-based replacement lights 10 illustrated in FIGS. 1-4. Alternatively, more than two planar surfaces can be included, and the surfaces can be angled relative to one another at angles other than 180°. For example, the heat sink can be circular, hexagonal, or have a different polygonal shape.

Figure 6:
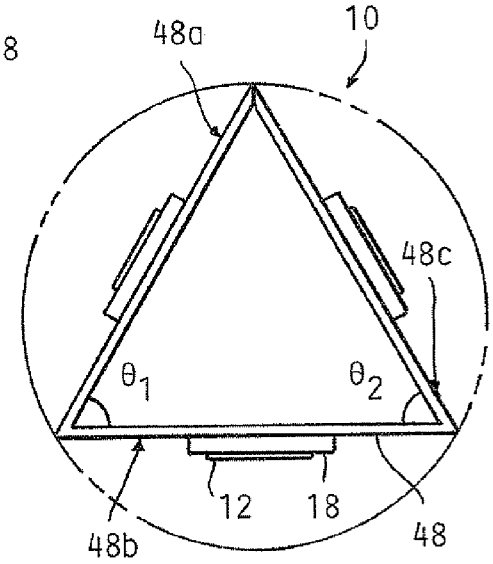
FIG. 6 is an end view of a triangular heat sink positioned in a tube.
Figure 7:
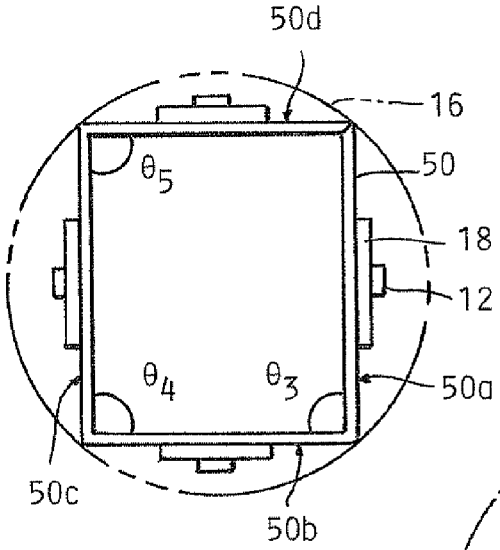
FIG. 7 is an end view of a rectangular heat sink positioned in a tube.

Heat sinks can undergo additional manufacturing steps prior to or following shaping. FIG. 6 illustrates an embodiment of the light 10 including a heat sink 48 having a triangular cross-section. In order to form the heat sink 48 into a triangle, the heat sink 48 is shaped to form an angle $\theta_1$ between sides 48*a* and 48*b*. In a separate shaping operation, side 48*b* is bent at an angle $\theta_2$ to form side 48*c*. Similarly, FIG. 7 illustrates a square heat sink 50. The square heat sink 50 is formed by shaping an angle $\theta_3$ between sides 50*a* and 50*b* and an angle $\theta_4$ between sides 50*b* and 50*c*. In a separate shaping operation, side 50*c* is bent at an angle $\theta_5$ to form side 50*d*. Thus, by performing multiple shaping operations, the heat sink 50 can include sides 50*a-d* facing around the entire circumference of the tube 16.

Figure 8:
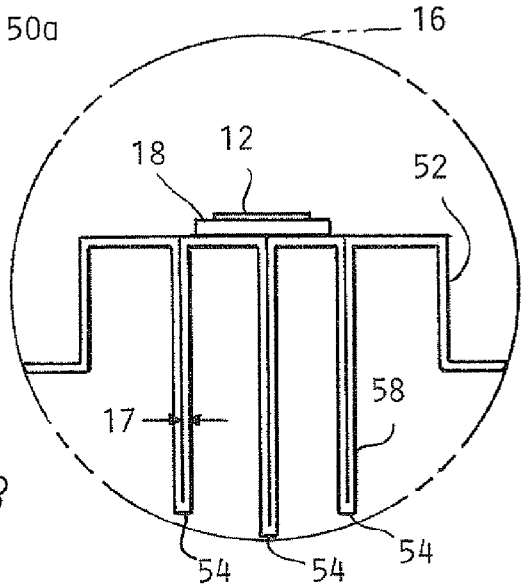
FIG. 8 is an end view of a first compressed heat sink in a tube.
Figure 9:
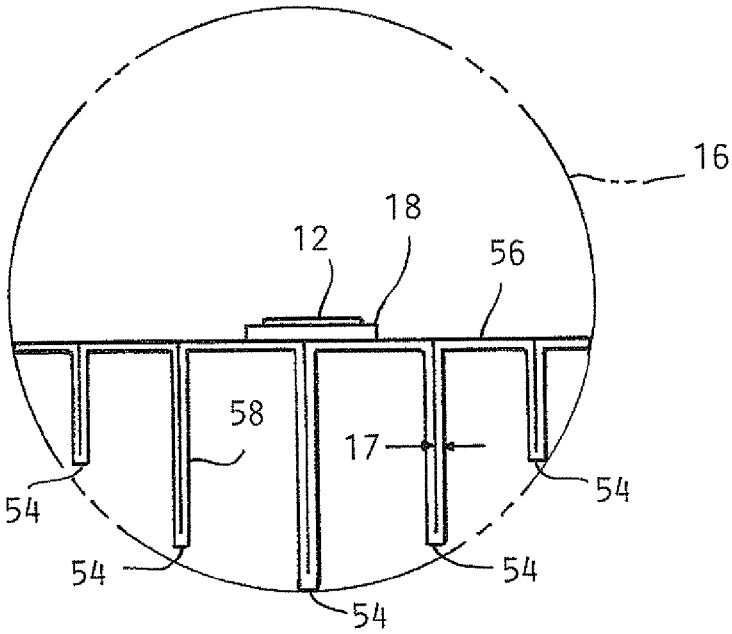
FIG. 9 is an end view of a second compressed heat sink in a tube.

After shaping, heat sinks can be compressed to form different shapes. FIGS. 8 and 9 illustrate examples of compressed heat sinks 52 and 56, respectively. After shaping a sheet of highly thermally conductive material to include open fins 22 defining a depression 23 as previously described, the shaped sheet can be compressed in a direction perpendicular to the longitudinal axis of the tube 18 to form heat sinks 52 and 56. By compressing the sheet of material shaped to include fins 22 defining depressions 23, the depressions 23 between the fins 22 are minimized or eliminated. The resulting closed fins 54 are twice the width 17 of the sheet of material since each closed fin 54 includes two parallel plies of the material abutting one another. Alternatively, compression can occur in a different direction, e.g., parallel to the longitudinal axis of the tube 18, depending on the orientation of the open fins 22. Thermal grease 58 can be applied in each depression 23 prior to compression, if desired.

Figure 10:
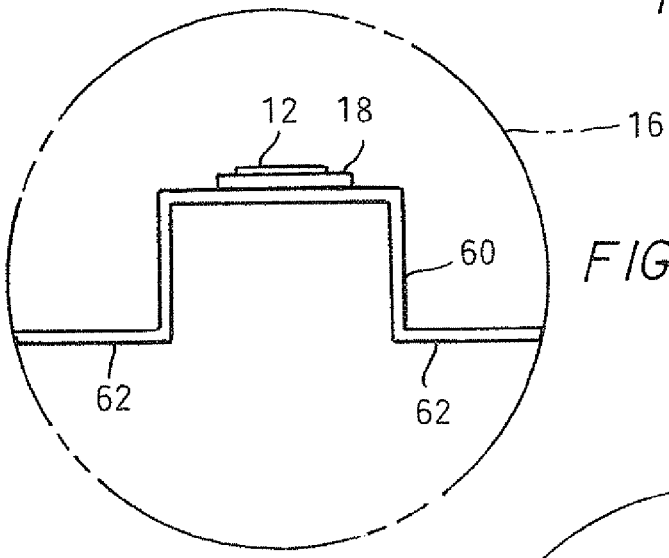
FIG. 10 is an end view of a first stepped heat sink in a tube.
Figure 11:
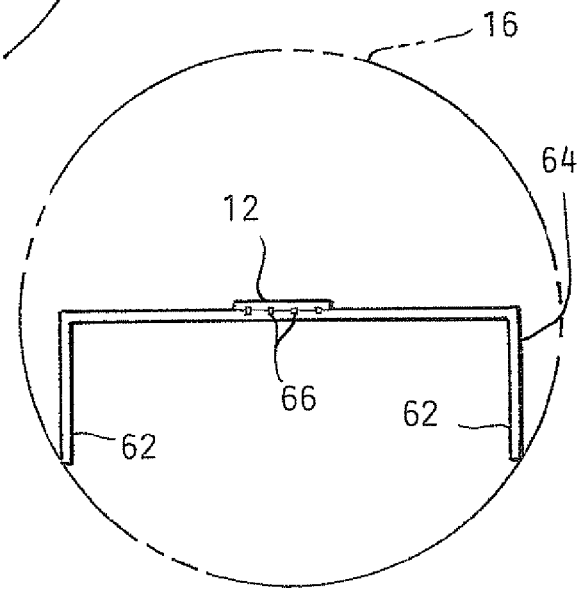
FIG. 11 is an end view of a second stepped heat sink in a tube.

Additional embodiments of the light 10 include heat sinks shaped to include stepped fins 62. For example, FIGS. 10 and 11 illustrate stepped heat sinks 60 and 64, respectively, with stepped fins 62 formed along the longitudinal edges of the heat sinks 60 and 64. Stepped fins 62 increase the surface area of the heat sinks 60 and 64 compared to a simple planar heat sink.

Also as illustrated in FIG. 11, connectors 66 are printed directly onto the heat sink 64 instead of using a circuit board 18. The heat sink 64 can be made of a high-dielectric material to avoid a short circuit.

Shaping a sheet of highly thermally conductive material to form a heat sink has several advantages compared to a conventional extruded heat sink. A shaped heat sink according to the present invention can be less expensive to manufacture than a conventional extruded heat sink. A shaped heat sink can simplify assembly of the light 10 by integrally including structures for connecting a cover 30 and end caps 20. A shaped heat sink can have a high surface area to width ratio to transfer heat from LEDs 12 to an ambient environment surrounding the light 10. A shaped heat sink can include multiple planar surfaces for mounting circuit boards 18 facing in different directions, thereby allowing LEDs 12 to emit light more uniformly around an arc of the LED-based replacement light 10 than known heat sinks. A shaped heat sink can be enclosed in a tube 16 or be made from a highly thermally conductive dielectric material to reduce a shock hazard potential due to capacitive coupling of a metal heat sink positioned adjacent a circuit board.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A method of forming a LED-based light for replacing a conventional fluorescent bulb in a fluorescent light fixture and including a plurality of LEDs, an elongate heat sink, an elongate light transmitting cover, the method comprising:

providing the heat sink by shaping an elongate sheet of highly thermally conductive material to include a plurality of longitudinally extending surfaces; wherein at least one longitudinal vertex is formed between two adjacent longitudinally extending surfaces;

mounting the plurality of LEDs in thermally conductive relation with and substantially along a length of at least one of the plurality of longitudinally extending surfaces; and enclosing the plurality of LEDs within the light transmitting cover such that the at least one longitudinal vertex engages an interior of the cover.

2. The method of claim 1, wherein at the least one of the plurality of longitudinally extending surfaces is a planar surface, and further comprising:

mounting the LEDs to a circuit board; and attaching the circuit board to the planar surface.

3. The method of claim 2, further comprising:

shaping at least one longitudinally extending open fin into the planar surface for dividing the planar surface into two parallel planar surfaces separated by a depression; and mounting the circuit board on the two parallel planar surfaces such that it spans the depression.

4. The method of claim 1, further comprising:

securing a circuit board to each of at least some of the plurality of longitudinally extending surfaces and mounting a first group of LEDs on the circuit board secured to a first of the plurality of longitudinally extending surfaces and mounting a second group of LEDs on the circuit board secured to a second of the plurality of longitudinally extending surfaces.

5. The method of claim 4, wherein the first longitudinally extending surface and the second longitudinally extending surface are angled relative to one another by approximately one of 60°, 90° and 180°.

6. The method of claim 4, wherein the plurality of longitudinally extending surfaces form least one at least one of a rectangular and a triangular cross-section, further comprising:

mounting LEDs on each of the plurality of longitudinally extending surfaces for emitting light through an entire circumference of the cover.

7. The method of claim 1 wherein the LED-based light includes at least one electrical connector, further comprising:

shaping the heat sink to have a high surface area to width ratio and a substantially constant thickness; and attaching the at least one electrical connector adjacent to a longitudinal end of the heat sink.

8. An LED-based light for replacing a conventional fluorescent bulb in a fluorescent light fixture formed according to the method of claim 1, wherein:

the light transmitting cover at least partially defines a tubular housing;

the heat sink has a high surface area to width ratio;

the at least one longitudinal vertex engages an interior of the cover; and the plurality of LEDs are enclosed within the tubular housing and mounted in thermally conductive relation with and substantially along a length of at least one of the plurality of longitudinally extending surfaces for emitting light through the cover.

9. The LED-based light of claim 8, wherein the heat sink has a substantially constant thickness.

10. The LED-based light of claim 8, wherein the at least one of the plurality of longitudinally extending surfaces is a planar surface, and wherein at least one LED of the plurality of LEDs is mounted to an elongate circuit board secured to the planar surface.

11. The LED-based light of claim 8, wherein the heat sink includes multiple longitudinally extending planar surfaces angled relative to one another for securing a plurality of circuit boards in different orientations onto the heat sink; and a first group of LEDs mounted on a first of the multiple planar surfaces and a second group of LEDs on a second of the multiple planar surfaces.

12. The LED-based light of claim 8, wherein the LED-based light includes at least one electrical connector at a longitudinal end of the tubular housing in electrical connection with the plurality of LEDs.

13. The LED-based light of claim 8, wherein the heat sink defines at least one open fin.

14. The LED-based light of claim 8, wherein the plurality of longitudinally extending surfaces includes two surfaces spaced apart in a direction perpendicular to the length the heat sink by a distance substantially equal to a width of a fastener for securing an electrical connector to the heat sink by engaging the fastener between the two surfaces.

15. The method of claim 1, wherein the shaping provides fins.

16. The method of claim 15, wherein the fins are open.

17. The method of claim 15, wherein the fins are closed.

18. The method of claim 1 wherein the plurality of longitudinally extending surfaces includes two surfaces spaced apart in a direction perpendicular to a longitudinal axis of the heat sink by a distance substantially equal to a width of a fastener, further comprising:

securing the fastener between the two surfaces for attaching an end cap to the heat sink.

19. An LED-based light for replacing a conventional fluorescent light bulb in a fluorescent light fixture, the LED-based light comprising:

a hollow, cylindrical light transmitting tube;

a heat sink shaped from a sheet of highly thermally conductive material having a width greater than a maximal width of the tube, the heat sink having a central planar portion and two side portions extending perpendicularly to the planar portion from opposing ends of the planar portion, the heat sink positioned within the tube with the side portions in contact with an interior of the tube;

a printed circuit board mounted on the central planar portion;

multiple LEDs longitudinally spaced along the length of the circuit board; and two end caps coupled to opposing ends of the tube, the end caps carrying bi-pin connectors in electrical communication with the circuit board.

20. The LED-based light of claim 19, wherein the heat sink has a substantially constant thickness.

21. The LED-based light of claim 19, further comprising:

at least one other circuit board mounted on at least one of the two side portions, wherein multiple LEDs are longitudinally spaced along the length of the at least one other circuit board.

22. The LED-based light of claim 19, wherein the at least one other circuit board is mounted on at least one of the two side portions, wherein multiple LEDs are longitudinally spaced along the length of the at least one other circuit board.

* * * * *